United States Patent [19]

Driesmans

[11] Patent Number: 4,469,085

[45] Date of Patent: Sep. 4, 1984

[54] GRILLE FOR BURNING SOLID FUELS IN STOVES, HEARTHS, OVENS, AND OTHERS

[75] Inventor: Jean Driesmans, Linden, Belgium

[73] Assignee: V.F.M. Verkoop en Fabrikatie van Metaalprodukten Naamloze Vennootscap, Belgium

[21] Appl. No.: 474,380

[22] Filed: Mar. 11, 1983

[30] Foreign Application Priority Data

May 17, 1982 [BE] Belgium ..... 59706

[51] Int. Cl.[3] ..... F23H 1/02

[52] U.S. Cl. ..... 126/160; 126/152 R; 126/77

[58] Field of Search ..... 126/160, 152 R, 163 R, 126/163 A, 174, 175, 77, 60, 61, 155, 168, 169, 285 A, 285 R; 98/41 SV

[56] References Cited

U.S. PATENT DOCUMENTS 384,177 6/1888 Smith ..... 126/160
1,672,792 6/1928 Thomas ..... 126/160
4,343,289 8/1982 Zimmerman ..... 126/77

FOREIGN PATENT DOCUMENTS 501112 6/1930 Fed. Rep. of Germany ... 126/152 R
600780 2/1926 France ..... 126/152 R
610787 10/1948 United Kingdom ..... 126/285 A

*Primary Examiner*—James C. Yeung
*Attorney, Agent, or Firm*—William A. Drucker

[57] ABSTRACT

The invention concerns a grille for burning all sorts of solid fuels in stoves, hearths, central heating boilers, baking ovens, combustion furnaces, drying kilns and others.

The grille exists of two grilles fitted one above the other and in contact with one another, one of said grilles is movable with respect to the other, the width of each passage opening in one of the grilles is greater in the middle of the grille, permitting to close gradually from their ends the passage openings of the other grille during the displacement of one of said grilles.

5 Claims, 6 Drawing Figures

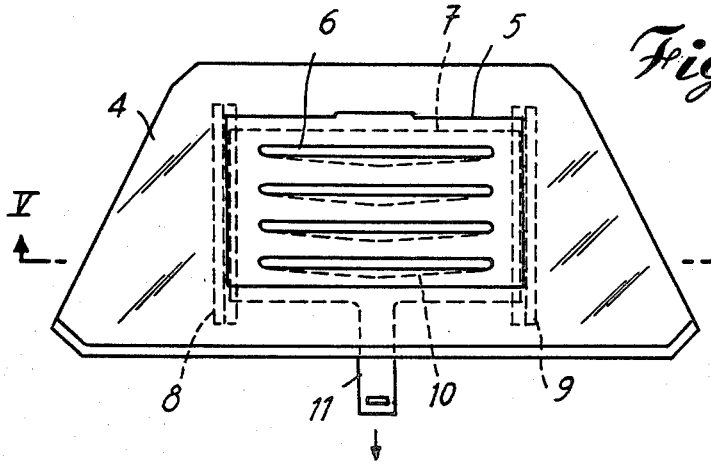
Fig. 4
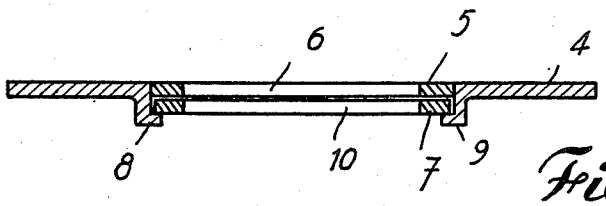
Fig. 5
Fig. 6
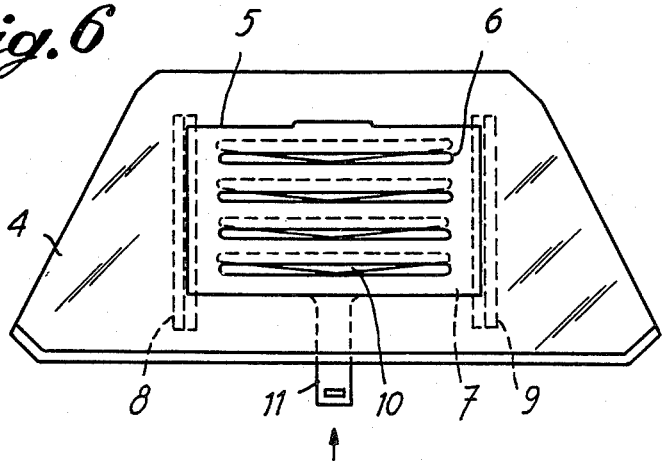

GRILLE FOR BURNING SOLID FUELS IN STOVES, HEARTHS, OVENS, AND OTHERS

The invention concerns a grille for burning all sorts of solid fuels in stoves, hearts, central heating boilers, baking ovens, combustion furnaces, drying kilns and others, in brief a grille for burning solid fuels in closed and open spaces.

The primary object of the invention is to construct a grille which makes it possible to control fires with a very high burning temperature and a high efficiency regardless of the type of solid fuel used. A further object is to keep the fireproof glass which is used in the door to close off, for example, a hearth or stove, free of soot, tar, and condensation. Yet another object is to achieve a grille which has a long service life.

Commonly known are grilles which when the combustion apparatus is operating at maximum capacity, the total amount of primary as well as virtually all secondary air can pass through. A drawback of these grilles, however, is that they allow the greatest amount of air to pass through where there is a minimum of resistance, in other words at the places where there is the least amount of fuel and the fire is the least strong. Here the superfluous or excess air is partly used as secondary air, which has an effect largely on the outside of the flames, giving rise to a poor and too rapid combustion of the fuel and the excessively rapid withdrawal of the hot exhaust gases into the chimney. Poor or inadequate efficiency is the result of such combustion apparatus. wall or door there is the further disadvantage that the glass very quickly becomes fouled with soot, tar and condensation, with the result that the glass becomes opaque and the heat radiated, which is very high through glass, drops significantly. Moreover in many cases the glass becomes overheated, so that the deposit on the glass is baked into it, with the result that the fire can hardly be seen anymore.

To remedy this, the grille as described by the invention, consists of two grilles situated one above the other and in contact with the other which can be moved with respect to one another and where the width of each passage opening in one of the grilles is greater in the middle of this grille, so that when one of the said grilles is moved the passage openings of the other grille can be gradually shut off from the ends of the openings.

This allows primary air only to be drawn through the grille in relation to the amount of air required in the centre and on the outsides of the fire. The centre of the fire can thus receive more air than the edges in relation to the position of the grilles with respect to one another. The primary air supply can therefore be adjusted in such a way that the airflow can be reduced towards the ends of the passage openings in the grilles, at the same time by gradually closing off these ends, more air can be supplied to the centre of the fire. A further advantage is that the greatest cooling action is at the site of the greatest concentration of fire on the grille, thus prolonging the service life of the grille considerably. When a glass door or wall is used in the combustion apparatus, a perfectly clean air curtain with a pure oxygen content of ±20% is created before the glass door or wall by supplying secondary air through an opening into the combustion space under the door and guiding this air vertically through the said combustion chamber so that the glass door or wall remains immaculately clean. Another advantage of the device described above is that carbon monoxide air pollution is markedly reduced and that the quantity of ash is reduced to a minimum.

By way of example, without in any way being exhaustive, a more detailed description is given below of a selected form of construction of the grille in accordance with the invention, applied to an open hearth. This description refers to the attached drawings, where:

Figure 1:
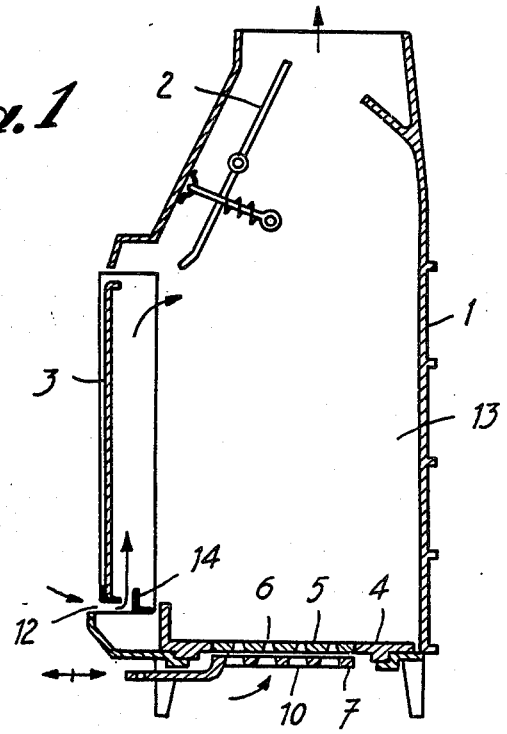
FIG. 1 shows a transverse section of an open hearth with a damper (U.S. register) and a glass door.
Figure 2:
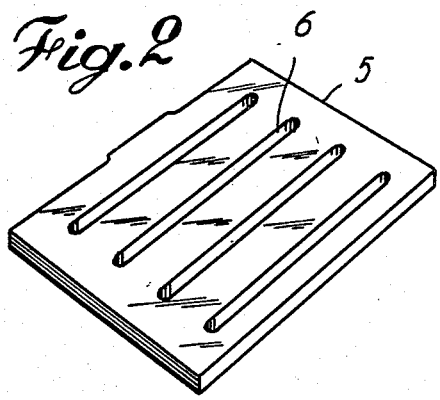
FIG. 2 shows a perspective view of the upper grille.
Figure 3:
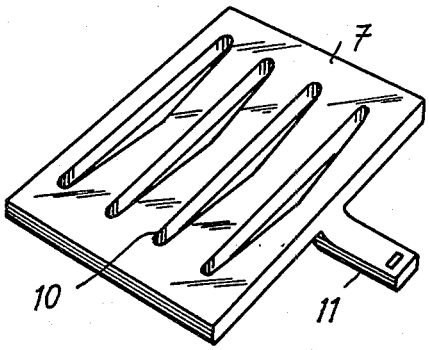
FIG. 3 shows a perspective view of the lower grille.

FIG. 4 gives a plan view of both grilles placed one above the other in a fixed plate;

FIG. 5 gives a longitudinal section along the line V—V in FIG. 4;

FIG. 6 gives a plan view of both grilles placed one above the other in a fixed plate but where the movable grille has been partially moved.

In these figures can be seen the open hearth 1 with damper 2, which is closed off by a glass door 3. Beneath the open hearth 1 is a fixed plate 4 into which a fixed grille 5 with oblong passage openings 6 with parallel sides has been fitted. Under and in contact with this grille a second grille 7 of the same dimensions as grille 5 is suspended so that it can move in two guide sections 8–9 which are attached to the lower side of plate 4. In this second grille 7 too, oblong passage openings 10 have been provided but here one of the lengthways sides of each of the openings has a shallow V-shaped, so that each opening is widest at its centre and is wider than the distance between the lengthways sides of the passage openings 6 of the first grille 5. These passage openings 6–10 in both grilles 5–7 may also have other shapes and may be in the form of holes arranged in a triangle, oval or round openings or other shapes, on condition that care is taken to ensure that the width of each passage opening 10 formed in grille 7 is larger towards the middle of the grille. In this way the grille could be fitted with openings which are larger than those at the sides of the grille, or more openings could be provided in the middle of the grille than at the sides. This grille 7 is provided at the front with a handle 11 which can be operated from the front of the open hearth, so that the said grille 7 can be slid back and forth with respect to grille 5. The air draught is at a maximum when the passage openings 6–10 of both grilles are precisely above one another. When, however, the lower grille 7 is slid until the passage openings 6 in grille 5 are closed off, no more air can pass through. Grille 7 can also be partially slid in guide sections 8-9 so that the ends of the passage openings 6 of grille 5 are closed and only the centre remains open. In this case each passage opening will have the form of a triangle. The centre section of the grille will thus receive more air than the edges, so that the combustion of the fuel on the grille will be strongest in the centre of the fuel. Adequate air control in relation to the desired size of the fire is thus possible. Under the glass door 3 an opening 12, which will by preference be oblong in shape, is provided for the intake of secondary air into the combustion space 13 and in this combustion space an air guide section 14 is installed before the said opening, in order to vertically deflect the entering air against the inside of the glass door 3, where the unburnt gases in the combustion space are mixed with the fresh supply of secondary air. As a result a perfectly clean air curtain with a pure oxygen content of ±20% is created before the glass door, so that it remains immaculately clean.

It goes without saying that the shape and dimensions of the parts described above, as well as their installation with respect to one another can differ and that also some of the parts described above could be replaced by others which have the same object, and at the same time remain within the scope of the invention.

I claim:

1. A grille for burning solid fuels in stoves, hearths, ovens and the like, comprising two grille-parts mounted one above the other, one of said grille-parts having oblong passage openings with parallel long sides, the second grille-part having oblong passage openings the width of which increases in the center of the grille-part, one of said grille-parts being fixed, the other of said grille-parts being movable with respect to the one fixed grille-part in a direction perpendicular to the oblong passage openings of both grille-parts and permitting the passage openings of the other grille-part to close gradually from their ends.

2. A grille as defined in claim 1, in which the passage openings in the second grille-part have the shape of a flattened triangle.

3. A grille for combustion apparatus and as defined in claim 1, comprising a base plate with opening in which the fixed grille-part rests, guide sections provided under said plate and, in which the movable grille-part is suspended, and a handle provided at the front of said movable grille-part permitting to move the movable grille-part at the front of the combustion apparatus.

4. A grille as defined in claim 1, and applied to a hearth having a glass door shutting-off the front of the hearth, an air opening provided in the hearth below said glass door for the supply of secondary air, and an air guide section provided within the hearth at a distance from said glass door permitting to deflect the supplied air upwards in the combustion space of the hearth and against said door.

5. Grille as defined in claim 1 in which the fixed grille lies in a plate and the moving grille is suspended under the fixed grille in guide sections of said plate, which moving grille is equipped with a handle manageable at the front of the combustion apparatus.

* * * * *